United States Patent [19]
Hioki et al.
[11] 4,244,751
[45] Jan. 13, 1981

[54] METHOD FOR MELT NITRIDING OF ALUMINUM OR ITS ALLOY

[75] Inventors: Susumu Hioki, Kashiwa; Toshihiro Yamada, Tomobemachi; Kazuyoshi Hatano, Minorimachi; Mitsuaki Haneda, Tomobemachi; Shoji Imanaga, Shimoinayoshi, all of Japan

[73] Assignee: Hitachi, Ltd., Japan

[21] Appl. No.: 52,200

[22] Filed: Jun. 26, 1979

[30] Foreign Application Priority Data

Jun. 30, 1978 [JP] Japan ..... 53-78683

[51] Int. Cl.[3] ..... C22F 1/04
[52] U.S. Cl. ..... 148/1; 148/4; 148/20.3

[58] Field of Search ..... 148/13.1, 20.3, 1, 4

[56] References Cited

U.S. PATENT DOCUMENTS 3,944,443 3/1976 Jones ..... 148/20.3

*Primary Examiner*—R. Dean
*Attorney, Agent, or Firm*—Craig & Antonelli

[57] ABSTRACT

Aluminum or its alloy is subjected to surface treatment wherein the surface is heated and melted by the heat of an electric arc in an atmosphere of a mixture of inert gas and nitrogen gas. By this treatment, a dense layer of aluminum nitride is formed on the surface of aluminum or its alloy so that material of increased wear resistance is obtained.

10 Claims, 2 Drawing Figures

METHOD FOR MELT NITRIDING OF ALUMINUM OR ITS ALLOY

BACKGROUND OF THE INVENTION

This invention relates to a method for melt nitriding of aluminum or its alloy capable of greatly increasing the wear resistance thereof.

When aluminum or its alloy is used for members adapted to move in sliding movement, it has hitherto been common practice to subject the aluminum-containing material to a suitable surface treatment, such as plating, anodic oxidation, etc., to increase its wear resistance, depending on the circumstances or conditions under which the specific sliding movement operates. When such surface treatment is carried out, a time-consuming operation must be performed because pre-treatment and after-treatment must be performed before and after the surface treatment, and special caution should be exercised in disposing of waste liquid. As a result, such surface treatment of the prior art has had the disadvantage of increasing the cost of products.

Also, aluminum or its alloy has strong affinity with oxygen in the air and readily combines therewith to form a dense layer of alumina ($Al_2O_3$) of very small thickness. The existance of this alumina layer interferes with any surface treatment that might be applied to the material. Because of this, there has been almost no established method available for nitriding of aluminum or its alloy.

OBJECT OF THE INVENTION

This invention has as its object the provision of a method for melt nitriding of aluminum or its alloy capable of imparting high wear resistance to the surface thereof readily in a short period of time.

SUMMARY OF THE INVENTION

The surface of aluminum or its alloy is heated in an atmosphere of a gas mixture of inert gas and nitrogen gas by utilizing the heat of an electric arc. Heating is carried out in such a manner that the surface of the workpiece is melted and maintained in molten state for several to ten-odd seconds, the period of time during which heating is carried out varying depending on the capacity of the heat source and the size of the workpiece. Only the portion of the workpiece in which nitriding is desired to occur is melted, and the melted portion is cooled gradually after being maintained in molten state for the period of time described above.

By this surface treatment, an alumina layer on the surface of the workpiece is destroyed and nitrogen is introduced and diffused in the melted portion of the workpiece, with a result that a nitride is formed on the surface of the workpiece to greatly increase wear resistance thereof.

As inert gas, argon gas may be used with advantage in view of the need to maintain the generated arc in a stable state.

The gas mixture of inert gas and nitrogen gas may contain a wide range of proportions of nitrogen gas. More specifically, its proportion may be 0.1% by weight when minimized and 50% by weight when maximized. Regardless of the proportion of nitrogen gas in the gas mixture, the gas mixture has a constant flow rate of 20 liters per minute. From this, it will be appreciated that the amount of nitrogen required for producing a nitride is very small, and when a large proportion of nitrogen gas is contained in the gas mixture, excess nitrogen gas effectively functions as a shield gas.

However, an increase in the proportion of nitrogen gas above 50% by weight is not desirable because the paucity of argon gas might exert unfavorable influences on the generating and maintaining of an electric arc in a stable state.

DESCRIPTION OF THE PREFERRED EMBODIMENT

Figure 1:
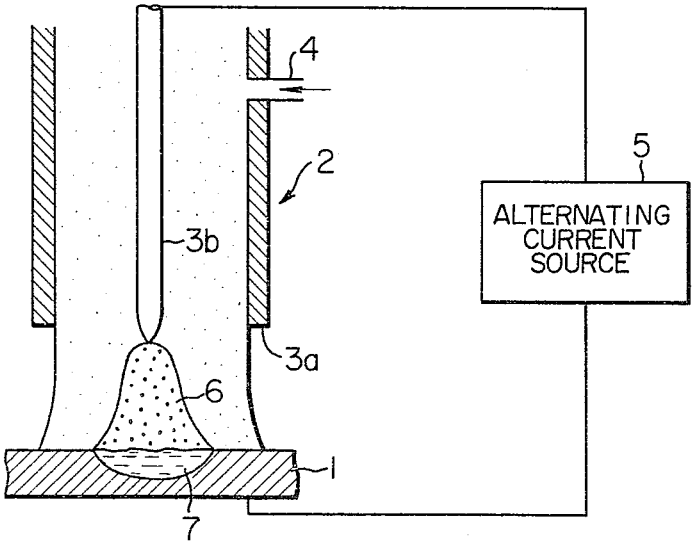
FIG. 1 is a view in explanation of the method for melt nitriding of aluminum or its alloy according to this invention.
Figure 2:
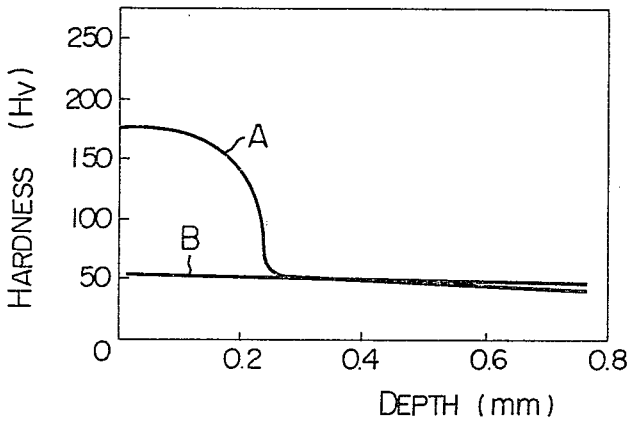
FIG. 2 is a graph showing the distribution of Vickers hardness of the surface of an aluminum-5% magnesium alloy treated by the method according to the invention.

A preferred embodiment of the present invention will be described by referring to the drawings. FIG. 1 is a view in explanation of the method for melt nitriding of aluminum or its alloy, and FIG. 2 is a graph showing the distribution of Vickers hardness on the surface of an aluminum alloy treated by the method according to the invention.

In FIG. 1 a TIG torch 2 including a nozzle 3 and a tungsten electrode **3*b* for generating an electric arc 6 is located above a plate 1 of aluminum alloy (aluminum-5% magnesium). A conduit 4 is connected to the nozzle 3 for supplying a gas mixture. An alternating current source 5 is connected between the plate 1 and tungsten electrode 3*b***.

When the plate 1 is subjected to melt nitriding treatment, a gas mixture is supplied through the conduit 4. In this embodiment, the gas mixture used contains, by weight, 50% of argon gas and 50% of nitrogen gas. The gas mixture of high nitrogen gas content is supplied at a flow rate of 20 liters per minute. The electric arc 6 is generated between the plate 1 and tungsten electrode **3*b* to heat the former and form a molten material pool 7 on the surface. After the surface is maintained in a molten state for about five seconds, the plate 1** is gradually cooled.

The surface hardness of the alumium alloy treated by the method described hereinabove was measured. In FIG. 2, Vickers hardness is set forth along the ordinate and the depth (mm) from the surface is represented along the abscissa. In the graph, a solid line curve A represents the distribution of hardness of an alloy treated for melt nitriding according to the present invention, and a solid line B represents the distribution of hardness of a similar alloy not treated. In the graph, it will be seen that the material treated according to the invention has about three times as high hardness as the untreated material in a range of depth of up to 0.2 mm from the surface and that the two materials have the same hardness when the depth is greater than 0.2 mm. An increase in surface hardness should mean an increase in wear resistance of the surface. More specifically, the material of the solid line B had a wear loss of $1\times10^{-4}$ $mm^2/kg$; while the material of solid line A had a wear loss of $1\times10^{-6}$ $mm^2/kg$, indicating that the present invention enables wear loss to be greatly reduced. It will be appreciated that if a member adapted to operate in sliding movement is subjected to this surface treatment to increase the wear resistance of its sliding surface, wear loss will be reduced and service life of the member can be lengthened.

From the foregoing description, it will be appreciated that the method according to the invention offers an advantage over the prior art in that the surface of material can be hardened to increase its wear resistance in a short period of time because the method has a very small number of steps. The invention enables aluminum or its alloy to be used as material for producing members adapted to move in sliding movement, in spite of aluminum or its alloy being unsuitable for this purpose when not treated to increase the wear resistance.

In the embodiment described hereinabove, a torch used for TIG welding (Gas Shielded Tungsten Arc Welding) and an alternating current source have been described as being used. However, it is to be understood that the method according to the invention can also be carried into practice by using a torch for plasma arc welding.

What is claimed is:

1. A method for melt nitriding of a surface layer of aluminum or its alloy comprising the steps of:

maintaining a surface layer of the aluminum or its alloy in a molten state for a predetermined period of time by heating the layer in an atmosphere of a gas mixture of inert gas and nitrogen gas by the heat of an electric arc to effect nitriding of the surface layer; and gradually cooling the surface layer therafter.

2. A method as set forth in claim 1, wherein the proportion of nitrogen gas in the gas mixture of inert gas and nitrogen gas is in a range between 0.10 and 50.0% by weight.

3. A method as set forth in claim 1, wherein the inert gas is argon.

4. A method as set forth in claim 1, wherein said predetermined period of time for maintaining the surface layer in molten state is sufficient to nitride the surface layer to a thickness of about 0.2 mm.

5. A method as set forth in claim 1, wherein said predetermined period of time is several seconds.

6. A method as set forth in claim 1 or claim 5, wherein said predetermined period of time is about five seconds.

7. A method as set forth in claim 1, wherein maintaining the molten surface layer of the aluminum or aluminum alloy in an atmosphere of a gas mixture of inert gas and nitrogen gas diffuses nitrogen into the molten surface layer of aluminum or aluminum alloy.

8. A method as set forth in claim 1, wherein said aluminum alloy is an aluminum-magnesium alloy.

9. A method as set forth in claim 1, wherein a portion of the surface layer is maintained in a molten state.

10. A method for melt nitriding of a surface layer of aluminum or aluminum alloy comprising;

flowing a gas mixture of argon gas and nitrogen gas against the surface of the aluminum or aluminum alloy;

generating an electric arc between an electrode and the surface layer of aluminum or aluminum alloy to form a molten pool of aluminum or aluminum alloy;

nitriding a surface layer of aluminum or aluminum alloy by diffusing nitrogen into said molten pool of aluminum or aluminum alloy; and gradually cooling the molten surface layer.

* * * * *